US006505658B2

(12) United States Patent
Koba

(10) Patent No.: US 6,505,658 B2
(45) Date of Patent: Jan. 14, 2003

(54) VENEER DEHYDRATING APPARATUS

(75) Inventor: Yoshinori Koba, Aichi (JP)

(73) Assignee: Meinan Machinery Works, Ltd., Obu (JP)

( * ) Notice: Subject to any disclaimer, the term of this patent is extended or adjusted under 35 U.S.C. 154(b) by 0 days.

(21) Appl. No.: 09/955,199

(22) Filed: Sep. 19, 2001

(65) Prior Publication Data

US 2002/0062876 A1 May 30, 2002

(30) Foreign Application Priority Data

Sep. 22, 2000 (JP) ..... 2000-288721

(51) Int. Cl.[7] ..... B27M 1/02; B30B 9/20

(52) U.S. Cl. ..... 144/2.1; 100/121; 100/176; 144/362; 492/30

(58) Field of Search ..... 100/121, 176; 144/2.1, 250.13, 250.16, 248.4, 248.7, 362; 492/30–32

(56) References Cited

U.S. PATENT DOCUMENTS 3,502,021 A * 3/1970 Kutz ..... 100/121
4,353,296 A * 10/1982 Beucker ..... 100/121
4,558,725 A * 12/1985 Veneziale ..... 100/121
4,559,106 A * 12/1985 Skytta et al. ..... 100/121
5,234,040 A * 8/1993 Koba ..... 100/176
5,529,100 A * 6/1996 Koba ..... 144/362

* cited by examiner

*Primary Examiner*—W. Donald Bray
(74) *Attorney, Agent, or Firm*—Armstrong, Westerman & Hattori, LLP

(57) ABSTRACT

A veneer dehydrating apparatus which has a pair of rotatable dehydrating roll assemblies disposed one above the other and having their axes extending parallel to each other, at least one of which is positively driven. The paired roll assemblies includes a first roll assembly having formed on the peripheral surface thereof a number of tooth-like projections extending radially outward from the peripheral surface and a second roll assembly having a steel core shaft which is clad with covering of elastic material such as urethane rubber with a predetermined thickness. The axes of the roll assemblies are a spaced radially to form a clearance or a nip between the peripheral surfaces thereof which is smaller than the thickness of the veneer sheet to be dehydrated. The second roll assembly has formed therein a number of annular grooves spaced axially of the second roll assembly at an interval of 50 mm or less and each having a width of 10 mm or less, thereby having a number of sectional elastic portions which are separated by any two adjacent annular grooves and each of such elastic portions being deformable independently of other similar portions.

14 Claims, 11 Drawing Sheets

VENEER DEHYDRATING APPARATUS

BACKGROUND OF THE INVENTION

Field of the Invention

The present invention relates to an apparatus for dehydrating green veneer by using a pair of rotatable dehydrating rolls one of which is a toothed roll and passing a veneer sheet through a nip formed between the peripheries of the rolls for mechanically squeezing part of water contained in the veneer sheet. More specifically, the invention relates to an improvement in such type of veneer dehydrating apparatus.

A typical veneer dehydrating apparatus of the type which has a pair of rolls for mechanically squeezing part of water from veneer sheet is disclosed, for example, in the Laid-open Unexamined Japanese Patent Application Publication (Kokai) H7-186106. This apparatus is constructed to include a pair of rotatable dehydrating roll assemblies disposed one above the other with the axes thereof extending parallel to each other and spaced so that a nip is formed between the peripheral surfaces of the roll assemblies, through which a sheet of green wood veneer is passed. More specifically, the paired roll assemblies are spaced from each other such that the peripheral surfaces thereof define a clearance for the nip whose dimension as measured radially of the rolls is about 75 to 90 percent of the thickness of the veneer sheet to be dehydrated. One of the roll assemblies includes a plurality of axially aligned steel roll sections each having formed on its peripheral surface a number of tooth-like projections whose height as measured in radial direction of the roll assembly from the peripheral surface thereof is less than the above clearance and pierceable into veneer sheet to exert compressive force. A pair of adjacent roll sections makes a set of roll sections with a total axial length of about 280 mm and a roll back-up device is located in an annular groove between each two adjacent sets of roll sections. The other roll assembly includes a steel roll clad with covering made of elastic material such as urethane rubber and having a thickness of about 6 mm and a Shore A hardness of about HS60. The covering has a plurality of cuts or annular grooves at positions corresponding to the above grooves in the toothed roll assembly to receive therein similar back-up devices. The apparatus further includes a conveyer for feeding a veneer sheet toward the nip between the roll assemblies.

With such apparatus, clearance of the nip between the upper and lower roll assemblies may be reduced, for example, to about 60 percent of veneer sheet thickness so that the veneer sheet is compressed by a greater force in an attempt to improve the dehydrating efficiency. In handling a veneer sheet having therein a hard portion such as a knot, however, such arrangement of roll assemblies for increased compression has problems. That is, when a knotty veneer sheet is passed through the apparatus, the steel roll sections of the toothed roll assembly will remain rigid, while the elastic covering of the other roll assembly in contact with a knot in veneer sheet is compressed to be deformed radially inward and, simultaneously, other part of the elastic covering adjacent to the knot is also subjected to deformation by tens ion. Thus, the knotty portion in veneer sheet receives a reaction force of an excessive magnitude and is compressed accordingly, with the result that the knot my be broken. This may make the veneer sheet void at the knot or allow a crack to occur in the veneer sheet thereby causing the sheet itself to break along the crack. Apparently production of such defective veneer sheets will cause a decrease in veneer yield rate. If such a defective veneer sheets having a void or crack is used in the subsequent processes, it will seriously affect the quality of the resulting products such as plywood or LVL boards.

Additionally, repeated compression of the elastic material during dehydrating operation will generate heat within the covering. Since the thermal conductivity of urethane rubber is rather low, the heat cannot be radiated readily, but accumulated within the covering. Such heat may cause the elastic covering to expand to such an extent that it is loosened and finally removed from the steel core shaft.

Covering of urethane rubber with a reduced hardness may be used to solve the above problems. With such covering, however, the urethane rubber itself is deformed excessively so that veneer sheet cannot be compressed sufficiently and, therefore, successful dehydration cannot be accomplished and the intended improvement in dehydrating efficiency cannot be achieved.

SUMMARY OF THE INVENTION

It is an object of the present invention, therefore, to provide a veneer dehydrating apparatus which can solve the above-identified problems.

To achieve the object of the invention, there is provided a veneer dehydrating apparatus having a pair of rotatable dehydrating roll assemblies disposed one above the other and having their axes extending parallel to each other, at least one of which is positively driven. The paired roll assemblies includes a first roll assembly having formed on the peripheral surface thereof a number of tooth-like projections extending radially outward from the peripheral surface and a second roll assembly having a steel core shaft which is clad with covering of elastic material such as urethane rubber with a predetermined thickness. The axes of the roll assemblies are spaced radially so as to form a clearance or a nip between the peripheral surfaces thereof which is smaller than the thickness of the veneer sheet to be dehydrated. The apparatus further includes a conveyer for feeding sheets of veneer successively into the nip between the roll assemblies.

The second roll assembly has formed therein a number of annular grooves spaced axially of the second roll assembly at an interval of 50 mm or less and each having a width of 10 mm or less. Thus, the second roll assembly has a number of sectional elastic portions which are separated by any two adjacent annular grooves. Each of such elastic portion is deformable independently of other similar portions.

When a veneer sheet having therein a hard portion such as a knot is being passed through the nip between the roll assemblies, elastic portions then adjacent to the knot are deformed by the compressive force exerted by the knot. The deformation occurs in such a way that the elastic portions reduce slightly their radial dimension while expanding outward and that such expansion is taken up by annular grooves. Thus, the deformation of the elastic portions 33 can occur more easily and hence the reaction force of the sectioned elastic portions acting on the knot is less than heretofore. Therefore, the knot is less susceptible to breakage, with the result that the aforementioned drawbacks and problems can be prevented successfully.

Each of the dimensions associated with the annular grooves, such as width and depth of each groove, interval at which the grooves are spaced, hardness of the elastic material for the covering, and the total diameter of the anvil roll assembly including the thickness of elastic covering, may be determined as required for the best results through experiment. For information, the description of the invention contains some examples of conditions under which good results were achieved.

The above and other objects, features and advantages of the invention will become apparent to those skilled in the art from the following description of a preferred embodiment of the veneer dehydrating apparatus according to the present invention, which description will be made with reference to the accompanying drawings, wherein:

DETAILED DESCRIPTION OF PREFERRED EMBODIMENT

The following will describe a preferred embodiment of the dehydrating apparatus constructed according to the present invention.

Figure 1:
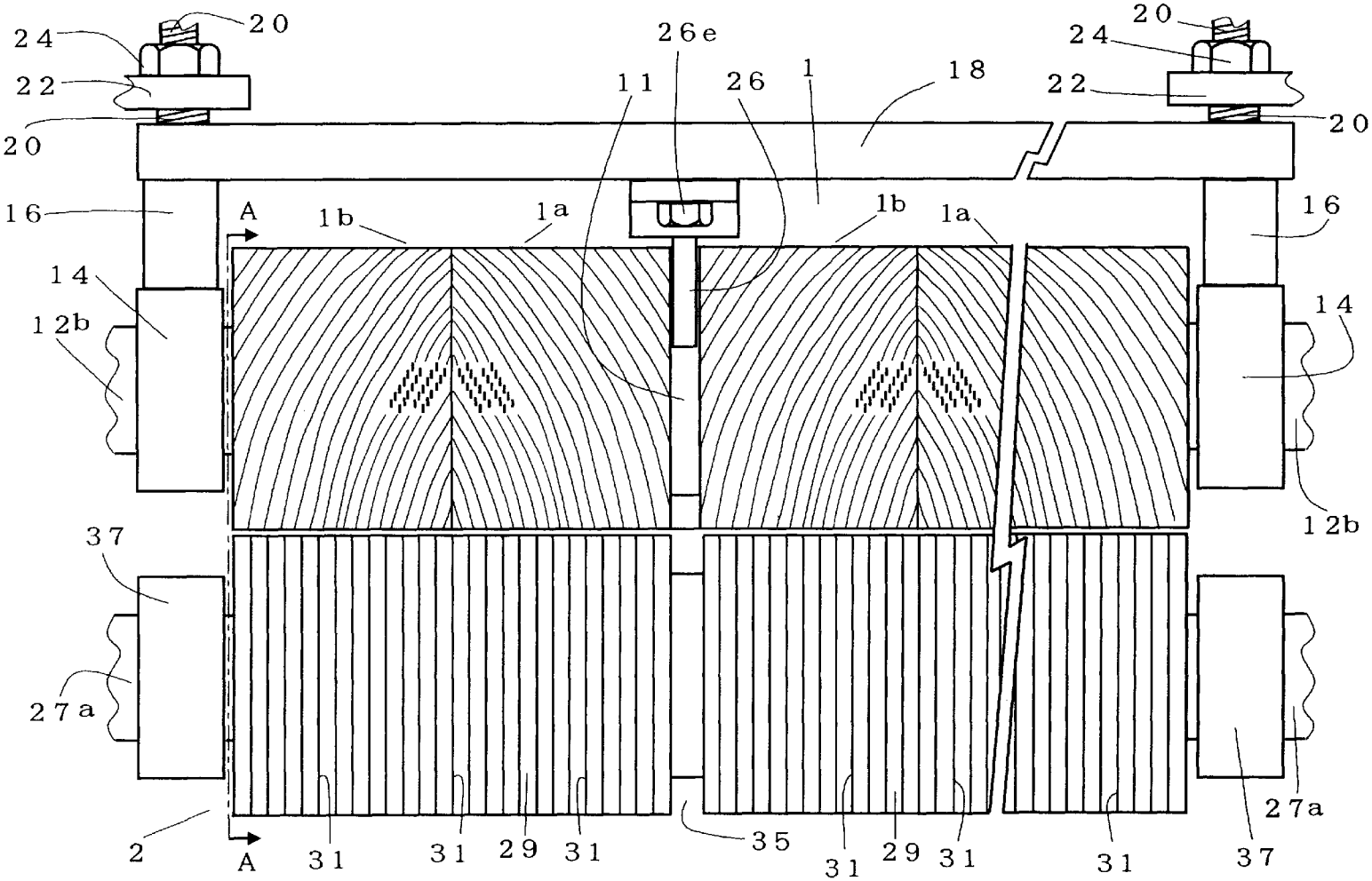
FIG. 1 is a front view, showing a preferred embodiment of veneer dehydrating apparatus of the present embodiment having a pair of first and second roll assemblies.
Figure 2:
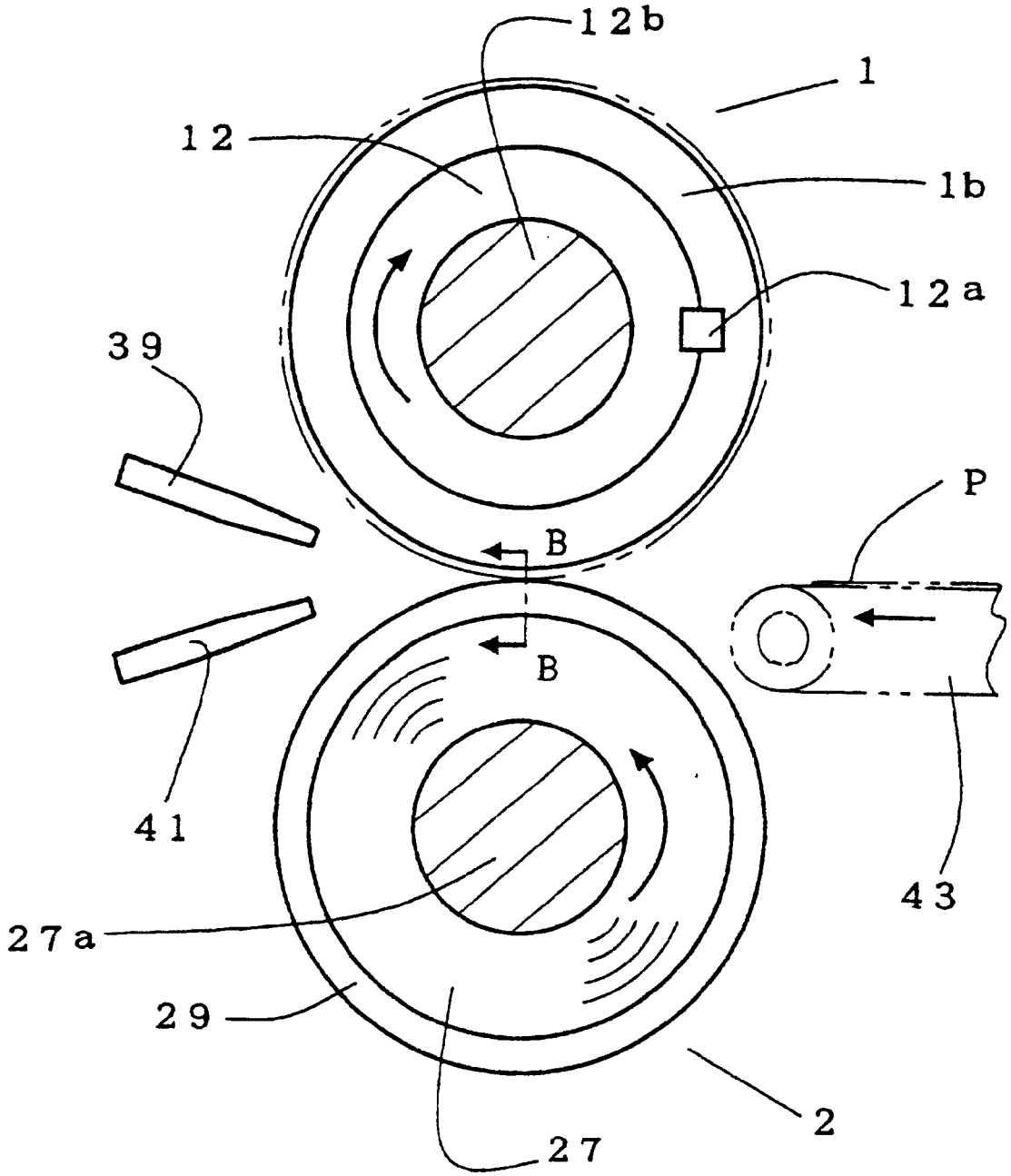
FIG. 2 is a partial cross-sectional view taken along line A—A of FIG. 1.

Referring to FIGS. 1 and 2 generally showing the preferred embodiment of the present invention, the veneer dehydrating apparatus comprises a pair of rotatable roll assemblies 1, 2 disposed one above the other with the axes thereof extending parallel to each other and spaced radially so as to provide a clearance for nip between the peripheries of the paired roll assemblies 1, 2. The upper roll assembly 1 includes a steel shaft 12 and a plurality of toothed roll sections 1*a*, 1*b* each having formed on the peripheral surface thereof a number of projections 3*a*, 3*b*, which will be described more in detail in later part hereof, and secured or keyed on the shaft 12 as shown at 12*a*. The shaft 12 is rotatably supported at the opposite ends 12*b* thereof by take-up bearing units 14 which are in turn fixedly connected by way of connecting rods 16 to a support plate 18 extending above the upper roll assembly 1. Threaded shafts or screws 20 are fixed to the support plate 18 at its ends, extending upward through plain holes formed in a stationary frame 22 of the apparatus. Nuts 24 are fitted on the screws 20, respectively, so that the upper toothed roll assembly 1 is adjustably moved toward and away from the lower anvil roll assembly 2 by turning the nuts 24. Though not shown in the drawing, the bearing units 14 are guided vertically by take-up frames which form a part of the apparatus frame.

The lower or anvil roll assembly 2 includes a steel shaft 27 with a diameter of about 170 mm, clad with elastic covering 29 made of urethane rubber with a thickness of about 30 mm and a Shore D hardness of about HS60. The anvil roll assembly 2 is rotatably, supported at the opposite ends 37 thereof by bearing units 37 to the stationary frame (not shown) of the apparatus. As shown in FIG. 1, the roll assembly 2 is formed at positions corresponding to spacers 11 of the toothed roll assembly 1, which will be referred to in later part hereof, with grooves 35 each having a width of about 8 mm and a depth of about 32 mm. That is, the groove 35 is cut throughout the elastic covering 29 and into the steel core shaft 27 by about 2 mm. The roll assembly 2 is thus separated by such grooves 35 into a plurality of roll sections and each of such roll sections is formed with a number of annular grooves 31 indicated by lines in FIG. 1, as will be described more in detail hereinafter. As an incidental matter with reference to the shaft 27, it may be made hollow for lightweightness.

In dehydrating a veneer sheet, for example, with a thickness of about 3.5 mm, the upper toothed roll assembly 1 is set through adjustment with the nuts 24 such that the clearance at the nip between the peripheral surfaces of the two roll assemblies 1, 2 becomes about 60 percent of the veneer sheet thickness, i.e. about 2.1 mm.

Though not shown in the drawings, there is provided a motor for driving both upper and lower roll assemblies 1, 2 through any suitable transmission such as gearing or belts so that the roll assemblies 1, 2 are rotated at the same peripheral speed in arrow directions as shown in FIG. 2. As will appreciated by those skilled in the art, it may be so arranged that only either one of the roll assemblies 1, 2 is driven by the motor and the other roll assembly is freely rotatable.

As shown in FIG. 2, the apparatus further includes a belt conveyer 43 provided on the upstream side of the paired roll assemblies 1, 2 for feeding in arrow direction a sheet of green veneer P to be dehydrated. On the opposite downstream side of the roll assemblies 1, 2 is disposed pairs of air nozzles 39, 41 which will be described more in detail hereinafter.

Now the following will e explain the structure of the upper toothed roll assembly 1 by describing the processes of shaping tooth-like projections 3*a*, 3*b* (FIGS. 8 and 10) on the roll sections 1*a*, 1*b* while having reference to FIGS. 3 through 10.

Figure 3:
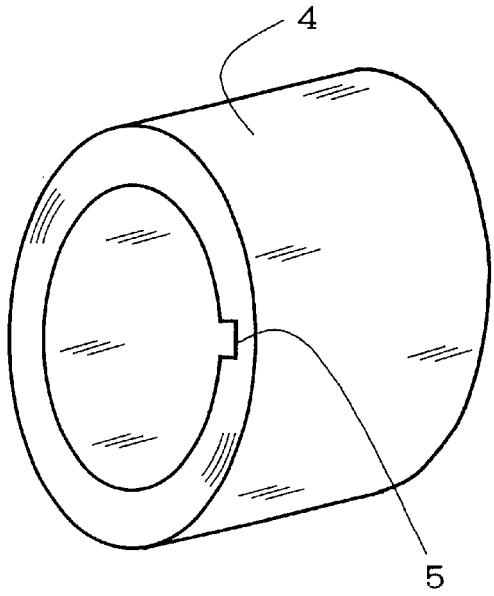
FIG. 3 is a perspective view showing a cylindrical steel block used as a material of roll section for the first one of the paired roll assemblies.

Firstly a cylindrical steel block 4, as shown in FIG. 3, is prepared for each of the roll sections 1*a*, 1*b*. The block 4 for the illustrated preferred embodiment has an axial length of about 140 mm, outer diameter of about 165 mm and inner diameter of about 75 mm, respectively. As seen in FIG. 3, the steel block 4 may be formed previously with a key way 5.

Figure 4:
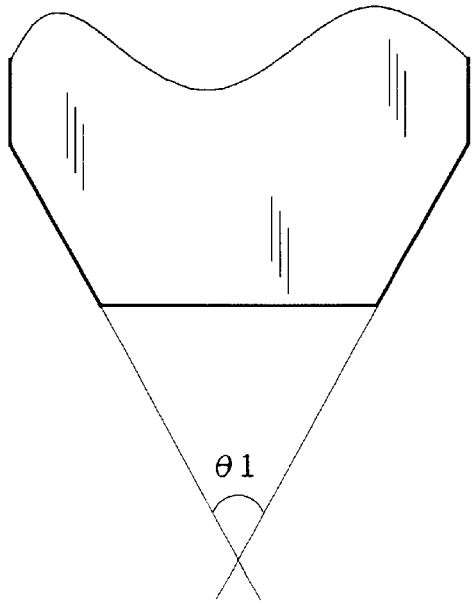
FIG. 4 shows a tool of a milling machine for forming spiral grooves on the steel block of FIG. 3.
Figure 5:
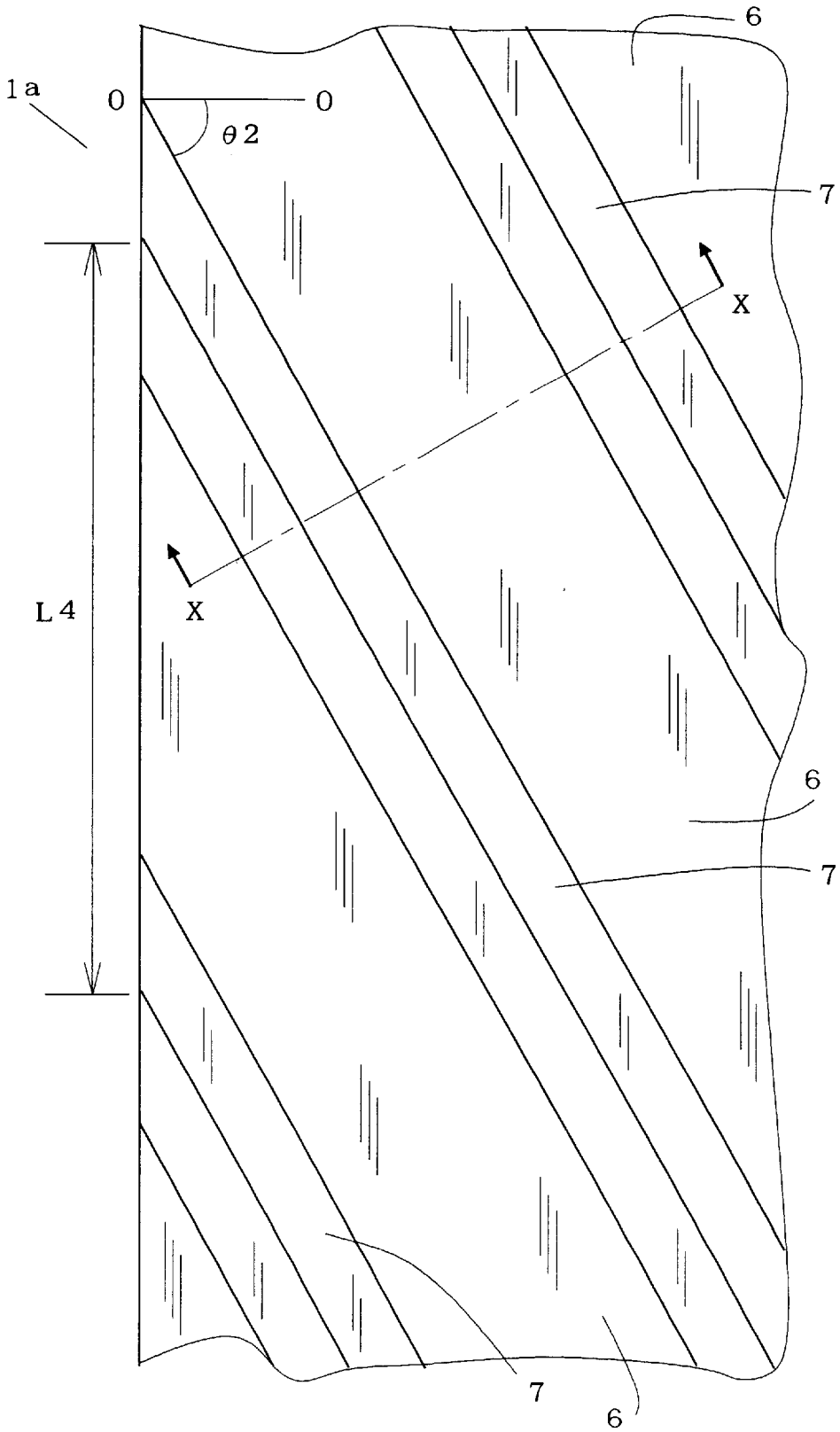
FIG. 5 is a partial enlarged view showing the surface of the steel block of FIG. 3 which is formed with the spiral grooves.
Figure 6:
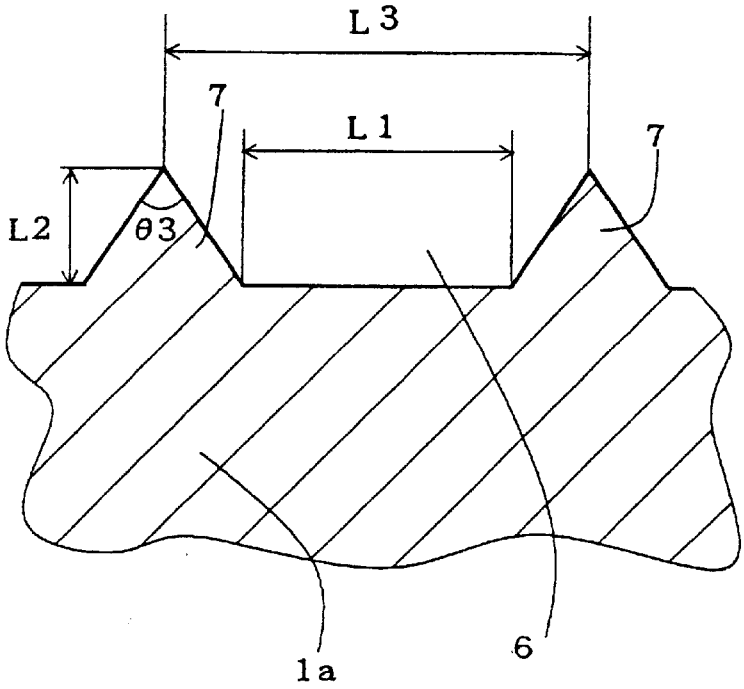
FIG. 6 is a partial cross-sectional view taken along line X—X of FIG. 5.

FIG. 4 shows a cutting or grooving tool having a width of about 3.5 mm as seen in the direction in which the tool is moved relative to the block 4 during cutting operation and an angle of about 70 degrees (θ1). Using this cutting tool on a milling machine a series of spiral grooves 6 with a depth of about 1.5) mm (L2. FIG. 6) is cut from the edge of one end of the edge of the other end of the block 4 at an angle of about 55 degrees (θ2. FIG. 5) with respect to line O—O which is parallel to axial line of the block 4, at substantially the same interval of about 11.5 mm (L4, FIG. 5). As a result, as many as 45 spiral grooves 6 are formed on the block surface as shown in FIG. 5. As indicated in the cross section of FIG. 6. spiral grooves 6 and projections 7 are formed alternately, wherein the width (L1) of the groove bottom surface 6*a* measures about 3 mm, the height (L2) of the projection 7 as measured from the bottom surface 6*a* is about 1.5 mm and its apex angle (θ3) as seen in the cross section is about 70 degrees.

Figure 7:
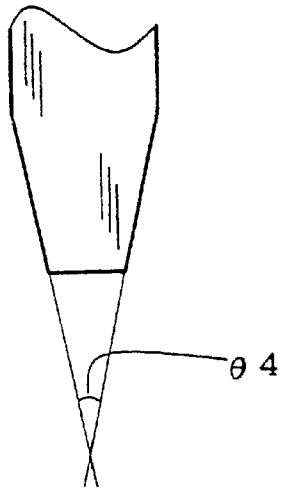
FIG. 7 shows a tool of a lathe or turning machine for making circular cuts thereby to form projections on the steel block of FIG. 3.
Figure 8:
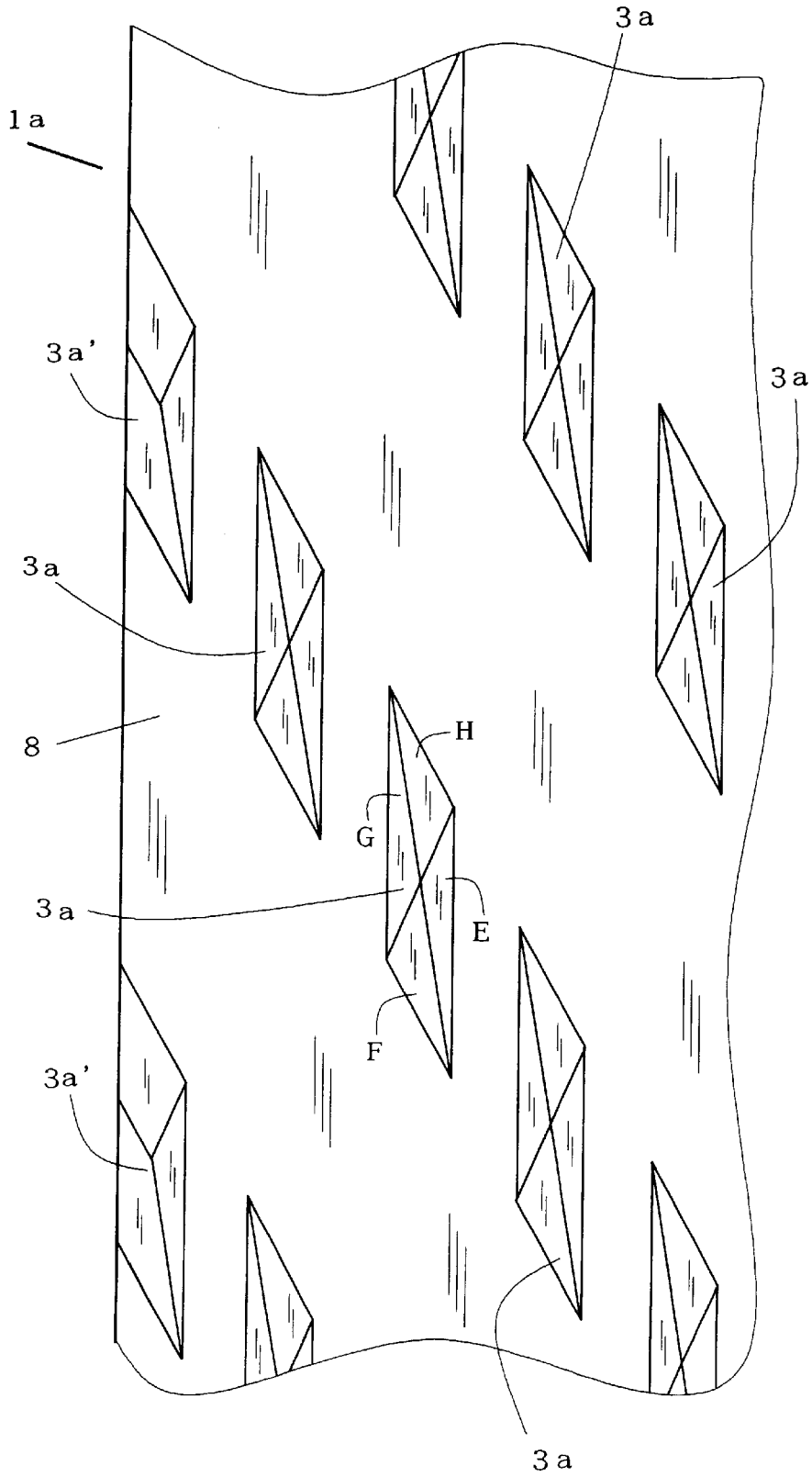
FIG. 8 is a partial enlarged view showing the surface of the steel block of FIG. 3 which is formed with pyramidal projections.

The using another cutting tool shown in FIG. 7 having a width of 1 mm as seen in the direction in which the tool is moved relative to the block 4 and an angle of 42 degrees (θ4) on a lathe, a number of circular or circumferential cuts with a depth of about 1.5 mm as measured from the tip of the spiral projection 7 is made on the block 4 diagonally across the spiral projections 7 at a spaced interval of about 2 mm as shown in FIG. 8. It is noted that in this cutting on the lathe the first cut is made with the tool set at a position about 2.1 mm spaced from the left-hand side edge of the steel block 4.

Such cutting of the spiral grooves 6 and making of the circumferential cuts results in the formation of a roll section 1*a* for the roll assembly 1, having formed on the peripheral surface thereof a number of tooth-like projections 3*a* as shown in FIG. 8. These projections 3*a* are located at a spaced interval of 11.7 mm in circumferential direction and at an interval of 2 mm in axial direction of the resulting roll section 1*a*, respectively. Each projection 3*a* is of a pyramidal shape whose height is 1.5 mm as measured from the peripheral surface of the roll section 1*a*, and has four triangular faces E, F; G and H which are all oblique with respect to an imaginary plane extending radially through the roll section 1*a*. Incidentally, the pyramidal projection 3*a* is shaped such that the angle formed by two opposite faces E and G is 42 degrees and the angle by the other two opposite faces F and H is 70 degrees. It is noted that the projections 3*a*' at the left extremity of the roll section 1*a* have a shape different from that of the other projections 3*a* by virtue of the manner of cutting as described above. Though the projection 3*a*' is less advantageous than the projection 3*a* of pyramidal shape with four faces E, F, G and H in terms of compression of wood veneer and hence dehydrating efficiency, overall efficiency will not be affected by the present of projections 3*a*' because their number is quite limited.

Figure 9:
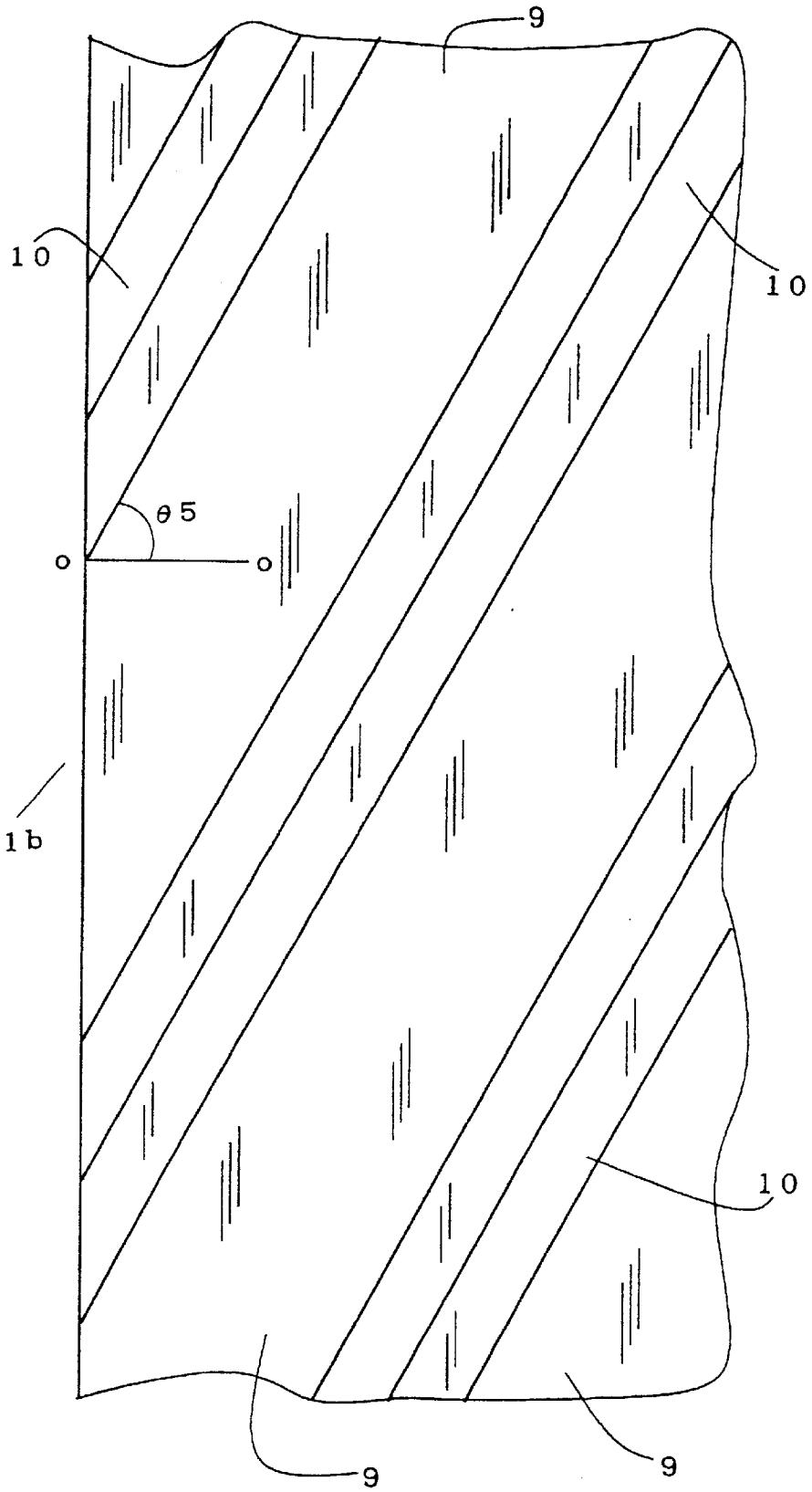
FIG. 9 is a partial enlarged view similar to that of FIG. 5, but showing the surface of the steel block FIG. 3 which is formed with spiral grooves extending in symmetrical relation to the grooves shown in FIG. 5.
Figure 10:
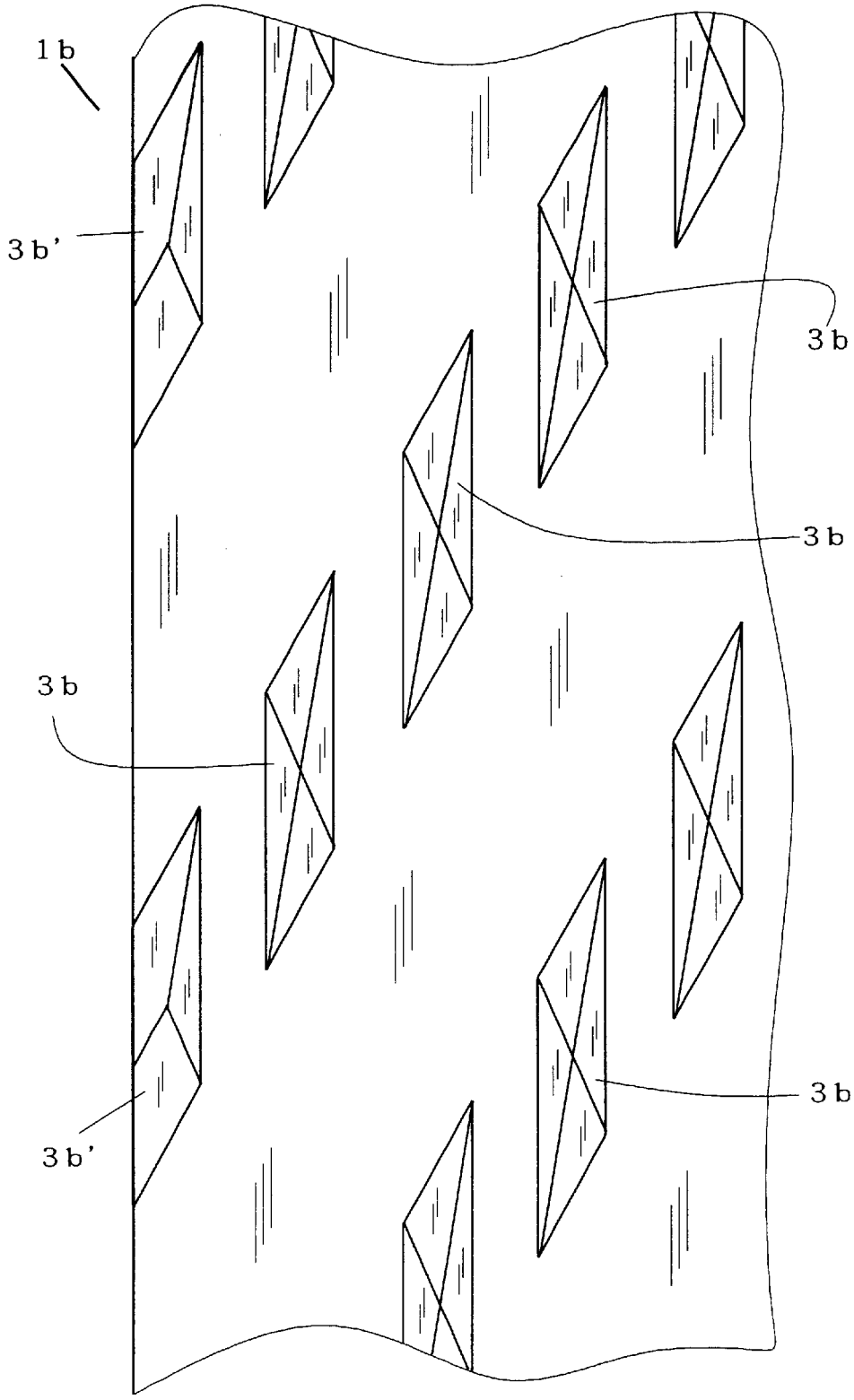
FIG. 10 is a partial enlarged view similar to that of FIG. 8, but showing the surface of the steel block of FIG. 3 which is formed with projections arranged in symmetrical relation to the projections shown in FIG. 8.

Tooth-like projections 3*b* for the other roll section 1*b* are formed in a manner similar to that in which the projections 3*a* for the roll section 1*a* have been formed, except that grooving by use of the cutting tool of FIG. 4 is performed such that the resulting spiral grooves 9 and projections 10 extend in the direction opposite to that of the counterparts 6, 7 at the same angle of 55 degrees (5) as shown in FIG. 9. The resulting pyramidal projections 3*b* are shown in FIG. 10. As will be understood from the above description, when the two rolls sections 1*a*, 1*b* are combined together in axial alignment as shown in FIG. 1, the shape of the projections 3*a* and 3*b* and the arrangement thereof are symmetrical about a plane at which the roll sections 1*a*, 1*b* are axially combined.

Referring to FIG. 1 again, two roll sections 1*a*, 1*b* are axially combined on the shaft 12 with the roll section 1*b* located on the left as seen from the upstream side of the apparatus. These two roll sections 1*a*, 1*b* makes one set of roll sections, and a plurality of such sets of roll sections 1*a*, 1*b* is keyed on the shaft 12.

The toothed roll assembly 1 further includes a steel ring-shaped spacer 11 which is interposed between any two adjacent sets of roll sections 1*a*, 1*b*. Each spacer 11 is 140 mm in outer diameter, 75 mm in inner diameter and 10 mm in thickness, and formed with a key way (not shown) similar to the one designated by 5 in FIG. 3. Appropriate number of section roll sets and spacer rings 11 are mounted on the shaft 12 so that the total axial length thereof becomes slightly larger than the width of veneer sheet to be dehydrated.

Figure 11:
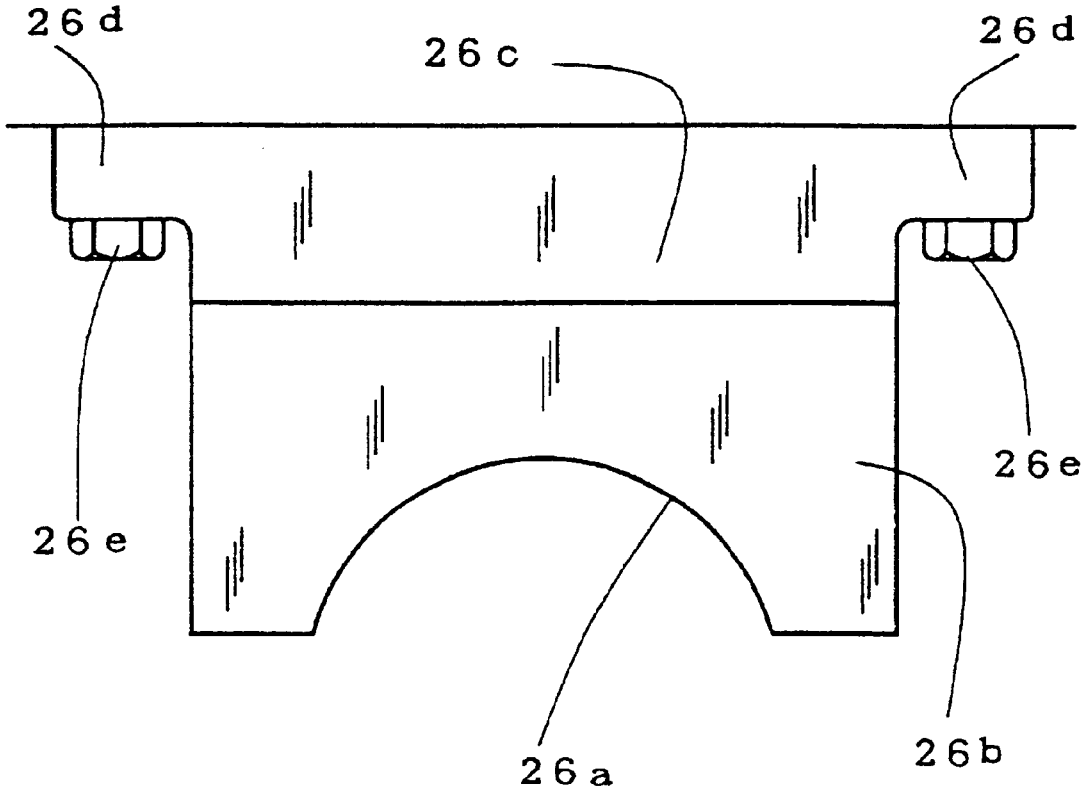
FIG. 11 is a side view of a roll back-up device.

Reference, numeral 26 in FIG. 1 designates a roll back-up device for preventing the toothed roll assembly 1 from being bent or deflected during dehydrating operation when a veneer sheet passing through the apparatus tends to cause the roll assembly 1 to be moved or bent upward. As shown in FIG. 11, each take-up device 26 is formed to have a back-up portion 26*b* having a thickness smaller than the spacer 11, say about 9 mm, and a curved surface 26*a*, a base portion 26*c* with a thickness of about 40 mm, and mounting portion 26*d* having formed therethrough holes for receiving bolts 26*e*. Such take-up device 26 is installed in each space between any two adjacent sets of roll section 1*a*, 1*b* in contact with the complementary outer circumferential surface of the ring spacer 11 and fixed to the support plate 19 by means of bolts 26*e*.

Figure 12:
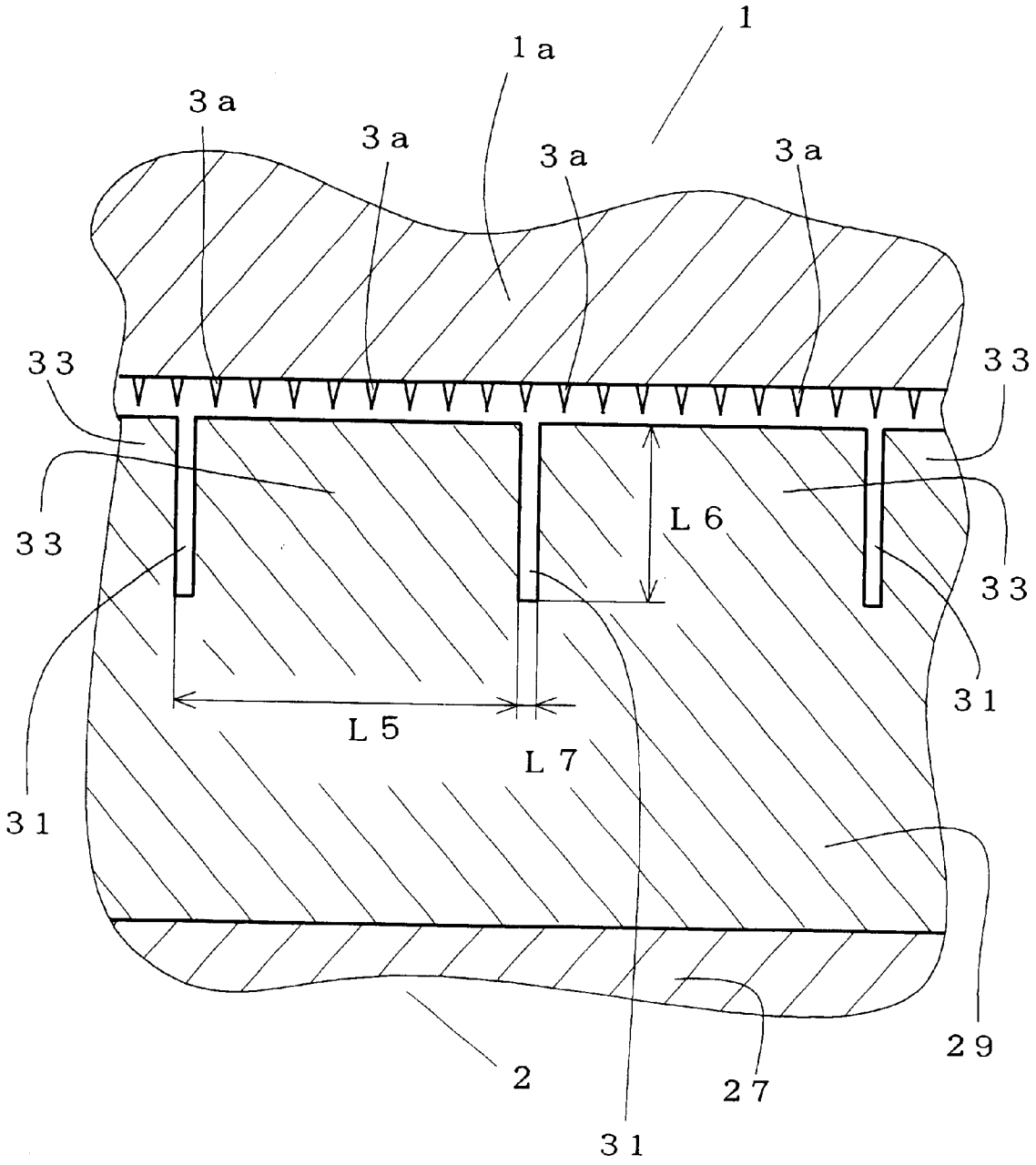
FIG. 12 is a partial cross-sectional view taken along line B—B of FIG. 2.

Now referring to FIGS. 1 and 12, the urethane rubber covering 29 of the lower anvil roll assembly 2 is formed in the peripheral surface thereof with a number of circular or annular grooves 31 cut at a predetermined interval (L5) of about 19 mm in the axial direction of the roll assembly 2. As shown more clearly in FIG. 12, each groove 31 has a depth (L6) of about 10 mm and a width (L7) of about 1 mm. In the drawing, reference numeral 33 designates an elastic p separated or sectioned by and hence interposed between any two adjacent grooves 31. Though not shown in the drawings, a back-up device similar to the device 26 of FIG. 11 is located in each of the groove 35 in a turned-upside-down position with its curved circular surface, corresponding to 26*a* of FIG. 11, placed in contact with the complementary steel shaft peripheral surface to support the anvil roll assembly 2 at the bottom and prevent the same assembly from being bent or deflected during dehydrating operation.

Since the upper toothed roll assembly 1 is set through adjustment with the nuts 24 to make the clearance at the nip between the peripheral surfaces of the two roll assemblies 1, 2 about 2.1 mm, or about 60 percent of about 3.5 mm of veneer sheet thickness and the height of each projection 3*a*, 3*b* is about 1.5 mm, the clearance at the nip between the tip ends of projections 3*a*, 3*b* on the toothed roll assembly 1 and the peripheral surface of the urethane rubber covering 29 of the anvil roll assembly 2 is about 0.6 mm.

The aforementioned pairs of air nozzles 39, 4 are located at positions corresponding to the spacers 11 and the grooves 35, respectively, and disposed to direct air jets for the purpose as will be explained later herein.

In operation of the apparatus thus constructed, a green veneer sheet P, for example, with a thickness of about 3.5 mm is placed onto the in feeding conveyer 43 with the wood fiber orientation of the veneer sheet directed along the direction in which the sheet is moved by the conveyor 43 toward the apparatus. The veneer sheet P, when passed through the nip between the upper and lower roll assemblies 1, 2, is compressed to reduce its thickness by the paired roll assemblies 1, 2. Since the urethane rubber of the elastic covering 29 then receives pressing reaction force from the veneer sheet P and is slightly deformed accordingly, the veneer sheet P is actually compressed to such an extent that its thickness is reduced to a little more than the original set clearance of about 2.1 mm between the peripheral surfaces of the roll assemblies 1, 2, that is, it is compressed to about 60 percent of its original thickness of about 3.5 mm. It is noted that the veneer sheet P is simultaneously compressed by the projections 3*a*, 3*b* then cutting into wood veneer sheet P. As mentioned earlier, because the triangular faces E, F, G and H of each projection 3*a*, 3*b* are all oblique with respect to an imaginary plane extending radially through the roll section 1*a*, 1*b*, the veneer sheet P is compressed in various directions oblique to the direction along the veneer sheet thickness. Such compression of the veneer sheet P causes part of the water contained therein to be mechanically squeezed out thereof, thus dehydrating of green wood veneer sheet being accomplished.

Most of the water squeezed out of veneer sheet P from its surface adjacent to the upper toothed roll assembly 1 is guided to flow toward the center of each paired roll sections 1*a*, 1*b* because of the convergent arrangement of the projections 3*a*, 3*b* on such roll sections 1*a*, 1*b* in rotation. Since no space is formed between the roll sections 1*a*, 1*b* of each pair, the water squeezed and guided toward the center is collected there on the veneer sheet P and then dropped by its own weight onto the lower anvil roll assembly 2 when the veneer sheet P has moved past the roll assemblies 1, 2. On the other hand, the water squeezed out of the veneer sheet P from its surface on the side adjacent to the lower anvil roll assembly 2 is dropped by its own weight onto the peripheral surface of the anvil roll assembly 2 and discharged. Part of the squeezed water flows to places corresponding to the spacers 11. and the grooves 35. If such water is moved together with the veneer sheet P to the delivery side of the apparatus, the veneer sheet P will absorb such water when it is expanded to resume its original thickness after moving past the apparatus. However, such water is blown away by air jets from the nozzles 39, 41, so that the water will not remain on and move with the veneer sheet P to the delivery side of the apparatus.

Figure 13:
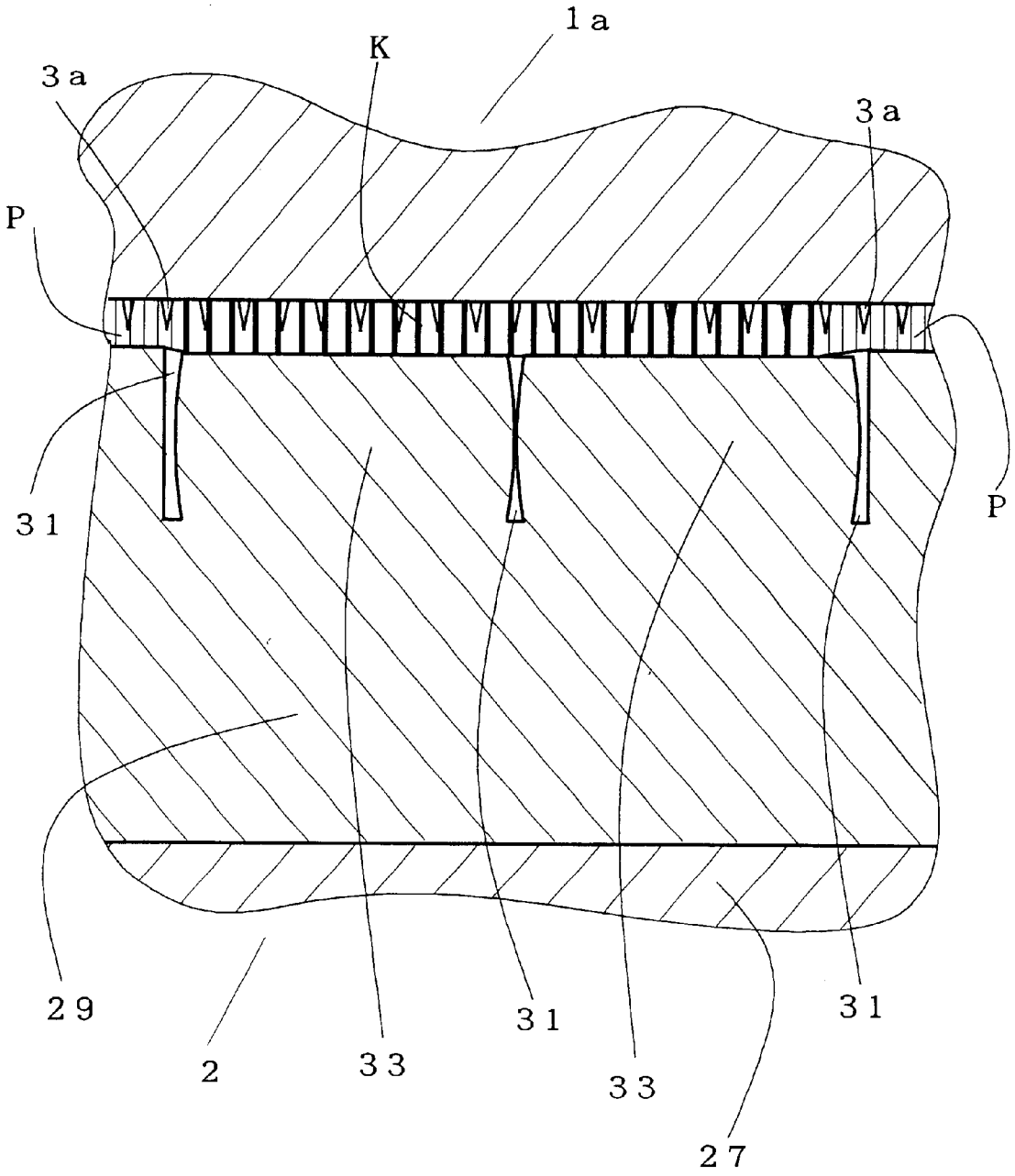
FIG. 13 is an illustrative view showing the operation of the dehydrating apparatus of the invention.

Now reference is made to FIG. 13 wherein bold short lines indicate the region of a knot which may be present in veneer sheet P and such knot is generally designated by reference symbol K. It is noted that bold short lines are used for indication of a knot K in veneer sheet for the sake of illustration of projections 3*a*. In the event that such a knot K passes through the nip between the roll assemblies 1, 2, the elastic portions 33 sectioned by annular grooves 31 and adjacent to the knot K are deformed by the compressive force exerted by the knot K in such a way that the sectioned elastic portions 33 reduce slightly their radial dimension while expanding outward as shown in FIG. 13. Because the compressive deformation of the sectional urethane rubber portions 33 take place independently of other similar portions and the outward expansion thereof is taken up by the grooves 31, the deformation of the elastic portions 33 can occur more easily than heretofore, so that the reaction force of the sectioned portions 33 acting on the knot K is less. Accordingly, the knot K is less susceptible to breakage as have occurred in veneer sheet dehydrated by the conventional apparatus as disclosed in the description hereof under the background of the invention. As a matter of course, the deformed elastic portions 33 resume their original shape after the veneer sheet P has moved past the nip between the roll assemblies 1, 2.

As mentioned earlier, the interior of the urethane rubber covering 29 tends to be heated by repeated compressive deformation. With the apparatus of the above-described embodiment, however, because part of the squeezed water enters into the grooves 31 and removed by its own weight and such flow of water is repeated during the dehydrating operation, the interior of the covering 29 can be cooled effectively. Thus, the anvil roll assembly 2 having formed therein grooves 31 can radiate the heat more easily than the roll having no such grooves. Therefore, a trouble associated with heat buildup within the elastic covering 29 can be prevented successfully.

Though both the upper and lower roll assemblies 1, 2 receive reactional forces from veneer sheet P being compressed during dehydrating operation, the provision of the back-up devices 26 for both roll assemblies 1, 2 at a spaced interval along the roll axial direction helps to maintain the original relative positions of the roll assemblies 1, 2.

In my experiment to find favorable conditions for veneer dehydrating, urethane rubber for the covering 29 with a Shore D hardness between HS40 and HS75 was used. For achieving better dehydrating results and while making knots K in veneer sheet less susceptible to breakage, though depending on other conditions, a Shore D hardness between HS55 and HS70 may be selected.

As to the grooves 31, generally the width (L7) should desirably be less than 10 mm and the interval (L5) at which they are spaced less than 50 mm, respectively.

For the sectioned elastic portions 33 of the elastic covering 29 to be deformed successfully as shown in FIG. 13 and the amount of water flowing to the delivery side of the apparatus from the grooves 31 to be lessened, the width (L7) of each groove 31 should be somewhere between 1 mm and 3 mm, though depending on the hardness of the elastic covering 29 and other conditions. Similarly, deformation of the covering 29 takes place easily if the groove depth (L6) is 5 mm or more, although more effective deformation can take place if the grooves 31 is formed with a depth of 15 mm or more. The thickness of the elastic covering 29 should desirably be 10 mm or more. For better results, the thickness may be 20 mm or more.

It is to be noted that each of the values or dimensions exemplified above may be selected or changed as required. That is, each of the values or dimension, including those for groove width, groove depth, groove interval, elastic covering hardness, covering thickness, and the total diameter of the anvil roll assembly including the thickness of elastic covering, may be determined through experiment by selectively changing the conditions of the anvil roll assembly 2 for each of any given conditions such as elastic cover hardness. For your information, our experiments showed good results under the following conditions, although these cases A through D do not intend to limit the scope of the invention.

| | Groove width | Groove depth | Groove Interval | Shore D hardness | Covering thickness | Total roll diameter |
|---|---|---|---|---|---|---|
| A | 1 mm | 15 mm | 30 mm | HS65 | 25 mm | 250 mm |
| B | 1 mm | 15 mm | 10 mm | HS65 | 25 mm | 250 mm |
| C | 1.5 mm | 28 mm | 15 mm | HS65 | 45 mm | 250 mm |
| D | 1.5 mm | 15 mm | 15 mm | HS60 | 25 mm | 250 mm |

It is also to be noted. the present invention is not limited to the above-described embodiment of apparatus structure, but it can be practiced in various changes and modifications. For example, the pyramidal projections 3*a*, 3*b* on the roll sections 1*a*, 1*b* of the toothed roll assembly 1 may be of such a figure that have more than four triangular faces, although pyramidal shape with a square base as shown in FIGS. 8 and 10 is easier to make. Furthermore, the projections 3*a*, 3*b* do not necessarily be pointed, but the tip ends thereof may be formed blunt as far as they can incise or pierce into wood veneer sheet.

Additionally, the upper toothed roll assembly 1 and the lower anvil roll assembly 2 may be reversed, namely the toothed roll assembly 1 is located below the roll assembly 2. In such an arrangement, however, provided that veneer feeding direction is the same as in the illustrated embodiment, the roll sections 1*a*, 1*b* should be changed so that squeezed water is guided and collected in the same manner as in the preferred embodiment,

What is claimed is:

1. Apparatus for dehydrating a sheet of green veneer by mechanically squeezing water therefrom comprising:

a pair of rotatable dehydrating roll assemblies disposed one above the other with the axes thereof extending parallel to each other, at least one of said roll assemblies being positively driven, said paired roll assemblies including, a first roll assembly having formed on the peripheral surface thereof a number of tooth-like projections extending radially outward from said peripheral surface and a second roll assembly having a core shaft clad with covering of elastic material with a predetermined thickness, said axes of the roll assemblies being spaced radially so as to form a nip between the peripheral surfaces thereof which is smaller than the thickness of the veneer sheet to be dehydrated;

conveyer for feeding sheets of veneer successively into said nip;

said covering of elastic material on said second roll assembly having formed therein a plurality of annular grooves spaced axially of said second roll assembly at an interval of 50 mm or less and each having a width of 10 mm or less, thereby forming an independently deformable elastic section separated by any two adjacent annular grooves.

2. Veneer dehydrating apparatus according to claim 1, wherein said annular grooves are spaced axially of said second roll assembly at an interval of 30 mm or less and each having a width of 5 mm or less.

3. Veneer dehydrating apparatus according to claim 2, wherein each of said annular grooves has a width of 3 mm or less.

4. Veneer dehydrating apparatus according to claim 3, wherein each of said annular grooves has a width of 1 mm to 2 mm.

5. Veneer dehydrating apparatus according to claim 1, wherein the elastic material of said covering has a Shore D hardness of HS40 to HS75.

6. Veneer dehydrating apparatus according to claim 5, wherein the elastic material of said covering has a Shore D hardness of HS55 to HS70.

7. Veneer dehydrating apparatus according to claim 1, wherein each of said annular grooves has a depth of 5 mm or more.

8. Veneer dehydrating apparatus according to claim 7, wherein each of said annular grooves has a depth of 15 mm or more.

9. Veneer dehydrating apparatus according to claim 1, wherein said elastic covering has a thickness of 10 mm or more.

10. Veneer dehydrating apparatus according to claim 9, wherein said elastic covering has a thickness of 20 mm or more.

11. Veneer dehydrating apparatus according to claim 1, wherein the total diameter said second roll assembly is 150 mm to 400 mm.

12. Veneer dehydrating apparatus according to claim 1, wherein said elastic material for the covering includes urethane rubber.

13. Apparatus for dehydrating a sheet of green veneer by mechanically squeezing water therefrom, comprising:

a pair of rotatable dehydrating roll assemblies disposed one above the other with the axes thereof extending parallel to each other, at least one of said roll assemblies being positively driven, said paired roll assemblies including a first roll assembly having formed on the peripheral surface thereof a number of tooth-like projections extending radially outward from said peripheral surface and a second roll assembly having a core shaft clad with covering of elastic material with a total diameter of 150 mm to 400 mm, said covering of elastic material having with a thickness of 10 mm or more and a Shore D hardness of HS40 to HS75, said axes of the roll assemblies being spaced radially so as to form a nip between the peripheral surfaces thereof which is smaller than the thickness of the veneer sheet to be dehydrated;

conveyer for feeding sheets of veneer successively into said nip;

said second roll assembly having formed therein a plurality of annular grooves spaced axially of said second roll assembly at an interval of 50 mm or less and each having a width of 10 mm or less and a depth of 5 mm or more, thereby forming an independently deformable elastic section separated by any two adjacent annular grooves.

14. Veneer dehydrating apparatus according to claim 13, wherein said elastic material for the covering includes urethane rubber.

* * * * *